US009098054B2

(12) United States Patent
Bin et al.

(10) Patent No.: US 9,098,054 B2
(45) Date of Patent: Aug. 4, 2015

(54) INTERLOCK SWITCH MECHANISM AND IMAGE FORMATION DEVICE UTILIZING THE SAME

(71) Applicants: Yan Bin, Shanghai (CN); Ye Yufeng, Shanghai (CN); Song Wenping, Shanghai (CN); Gao Xiaoliang, Shanghai (CN); Zhang Jianjin, Shanghai (CN)

(72) Inventors: Yan Bin, Shanghai (CN); Ye Yufeng, Shanghai (CN); Song Wenping, Shanghai (CN); Gao Xiaoliang, Shanghai (CN); Zhang Jianjin, Shanghai (CN)

(73) Assignee: Ricoh Company, Ltd., Tokyo (JP)

( * ) Notice: Subject to any disclaimer, the term of this patent is extended or adjusted under 35 U.S.C. 154(b) by 39 days.

(21) Appl. No.: 13/766,890

(22) Filed: Feb. 14, 2013

(65) Prior Publication Data

US 2013/0223875 A1 Aug. 29, 2013

(30) Foreign Application Priority Data

Feb. 24, 2012 (CN) ..... 2012 1 0043430

(51) Int. Cl.

| | |
|---|---|
| ***G03G 21/16*** | (2006.01) |
| ***H01H 9/20*** | (2006.01) |
| ***H01H 3/16*** | (2006.01) |
| ***H01H 9/22*** | (2006.01) |

(52) U.S. Cl.

CPC ..... *G03G 21/1623* (2013.01); *H01H 3/161* (2013.01); *H01H 9/20* (2013.01); *H01H 9/22* (2013.01)

(58) Field of Classification Search

CPC . G03G 21/1623; G03G 21/1633; H01H 9/20; H01H 3/161; H01H 9/22

USPC ..... 399/107, 110, 114

See application file for complete search history.

(56) References Cited

U.S. PATENT DOCUMENTS

| | | | | |
|---|---|---|---|---|
| 3,597,556 | A * | 8/1971 | Sharp et al. | 218/4 |
| 4,525,611 | A * | 6/1985 | Akamatsu et al. | 200/83 R |
| 7,511,238 | B2 | 3/2009 | Sugane et al. | |
| 2009/0008231 | A1 * | 1/2009 | Sugane et al. | 200/330 |

FOREIGN PATENT DOCUMENTS

| | | |
|---|---|---|
| JP | 2009-037997 | 2/2009 |

* cited by examiner

*Primary Examiner* — Ryan Walsh
*Assistant Examiner* — Philip Marcus T Fadul
(74) *Attorney, Agent, or Firm* — Harness, Dickey & Pierce, P.L.C.

(57) ABSTRACT

Disclosed are an interlock switch mechanism and an image formation device. The interlock switch mechanism comprising a main body; a first link rod which is disposed on the main body, and may swing by centering on a supporting point, wherein, a supporting shaft is disposed at one end of the first link rod; a second link rod which is supported by the supporting shaft, wherein, two ends of the second link rod may swing by centering on the supporting shaft; an action part which, under a second force, may touch one end of the second link rod so as to cause another end of the second link rod to swing toward an actuator; and a stroke extension mechanism which, under a first force, may cause the first link rod to swing so as to cause the other end of the second link rod to swing toward the actuator.

9 Claims, 7 Drawing Sheets

INTERLOCK SWITCH MECHANISM AND IMAGE FORMATION DEVICE UTILIZING THE SAME

BACKGROUND OF THE INVENTION

1. Field of the Invention

The present invention relates to an interlock switch mechanism and an image formation device utilizing the same, more particularly relates to an interlock switch mechanism having a stroke extension mechanism and an image formation device including the interlock switch mechanism.

2. Description of the Related Art

FIG. 8 illustrates a conventional interlock switch mechanism 200. As shown in FIG. 8, the interlock switch mechanism 200 contains a first link rod 201, a spring 206, a second link rod 203, a rotation part 204, and an action part 205.

The first link rod 201 may swing in a vertical plane by centering on a supporting point 201A. The spring 206 may cause the first link rod 201 to return to an initial position (i.e., a position where a switch 202 is turned off). The second link rod 203 is supported by a supporting shaft 201B disposed at the end 201C of the first link rod 201 so that two ends 203A and 203B of the second link rod 203 may swing in the vertical plane. The end 203A of the second link rod 203 faces an actuator 202A of the switch 202. The rotation part 204 is shaped like a cam, and may rotate with respect to a rotation shaft 204B. Furthermore the rotation part 204 has an arc portion 204A1 with a predetermined radius, a contacting portion 204A2, and a coil spring 204C for causing the rotation part 204 to return to the initial position. The arc portion 204A1 may touch the other end 203B of the second link rod 203. The action part 205 is disposed at another end 201D of the first link rod 201.

FIG. 9 illustrates a conventional image formation device 100. The above described interlock switch mechanism 200 is used in the image formation device 100. As shown in FIGS. 8 and 9, the image formation device 100 contains a housing 100A, a first door 24, a second door 25, a first movable part 300, and a second movable part 301. Here it should be noted that the two movable parts 300 and 301 are shown in FIG. 8.

A first boss 24*a* is disposed on the inner surface of the first door 24. A second boss 25*a* is disposed on the inner surface of the second door 25. A first opening 100A1 and a second opening 100A2 are disposed on side walls of the housing 100A, facing the bosses 24*a* and 25*a*, respectively. The two bosses 24*a* and 25*a* may be inserted into the openings 100A1 and 100A2, respectively. The first movable part 300 is disposed inside the image formation device 100, and may be pushed by the first boss 24*a*. The second movable part 301 is disposed inside the image formation device 100, and may be pushed by the second boss 25*a*. The first movable part 300 faces the contacting portion 204A2 of the rotation part 204 in the interlock switch mechanism 200, and the second movable part 301 faces the action part 205 in the interlock switch mechanism 200.

In a process of closing the first door 24 of the image formation device 100, the first boss 24*a* pushes the first movable part 300. Then the first movable part 300 overcomes an elastic force of the coil spring 204C so as to push the contacting portion 204A2 of the rotation part 204 in the interlock switch mechanism 200. In this way, the arc portion 204A1 touches the other end 203B of the second link rod 203.

In a process of closing the second door 25 of the image formation device 100, the second boss 25*a* pushes the second movable part 301. Then the second movable part 301 overcomes an elastic force of the spring 206 so as to push the action part 205 in the interlock switch mechanism 200. In this way, the first link rod 201 swings so that its end 201C moves upward, and then the supporting shaft 201B of the second link rod 203 moves upward too.

On the other hand, since the other end 203B of the second link rod 203 is stopped by the arc portion 204A1 of the rotation part 204, the end 203A of the second link rod 203 moves upward so as to approach the actuator 202A of the switch 202. When the first door 24 and the second door 25 are closed fully, the end 203A of the second link rod 203 activates the actuator 202A of the switch 202.

The switch control accuracy of the conventional interlock switch mechanism 200 is relatively low. In a case where the first door 24 or the second door 25 is opened by a relatively small angle (for example, less than 25 degrees), there is a problem that the switch 202 cannot be effectively turned off, i.e., is still in a turn-on state.

SUMMARY OF THE INVENTION

In the light of the above problem, one aim of the present invention is to provide an interlock switch mechanism, particularly to provide an interlock switch mechanism having a stroke extension mechanism so as to improve the switch control accuracy of the interlock switch mechanism. Another aim of the present invention is to provide an image formation device having the interlock switch mechanism.

According to one aspect of the present invention, there is provided an interlock switch mechanism. The interlock switch mechanism comprises a main body; a first link rod which is disposed on the main body, and may swing by centering on a supporting point, wherein, a supporting shaft is disposed at an end of the first link rod; a second link rod which is supported by the supporting shaft at the first link rod, wherein, first and second ends of the second link rod may swing by centering on the supporting shaft; an action part which, under an action of a second external force, may make contact with the first end of the second link rod so as to cause the second end of the second link rod to swing toward an actuator of a switch; and a stroke extension mechanism which, under an action of a first external force, may cause the first link rod to swing so as to cause the second end of the second link rod to swing toward the actuator of the switch. A first stroke of the stroke extension mechanism generated by the first external force is converted to a second stroke normal to the first stroke by the stroke extension mechanism, and the second stroke is greater than the first stroke.

In addition, according to another aspect of the present invention, there is provided an image formation device. The image formation device comprises the interlock switch mechanism.

DETAILED DESCRIPTION OF THE PREFERRED EMBODIMENTS

In order to let those people skilled in the art better understand the present invention, hereinafter, the preferred embodiments of the present invention will be concretely described with reference to the drawings. However it should be noted that the same symbols, which are in the specification and the drawings, stand for constructional elements having basically the same function and structure, and repeated explanations for the constructional elements are omitted.

Figure 1A:
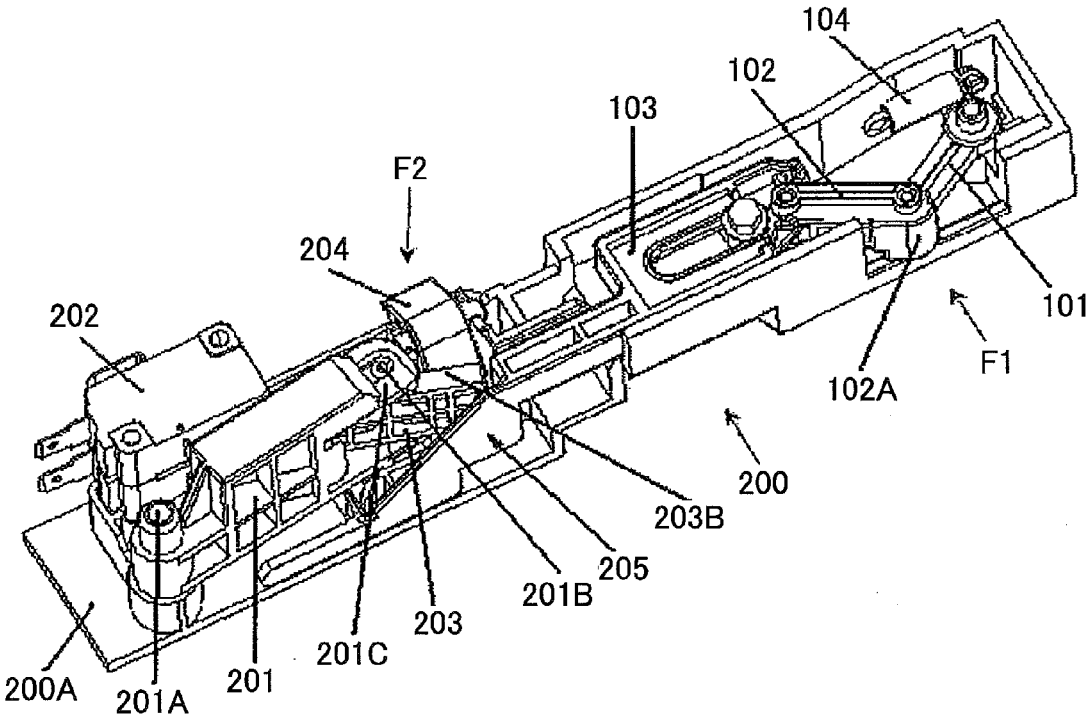
FIGS. 1A and 1B are perspective views of an interlock switch mechanism according to a first embodiment of the present invention.
Figure 1B:
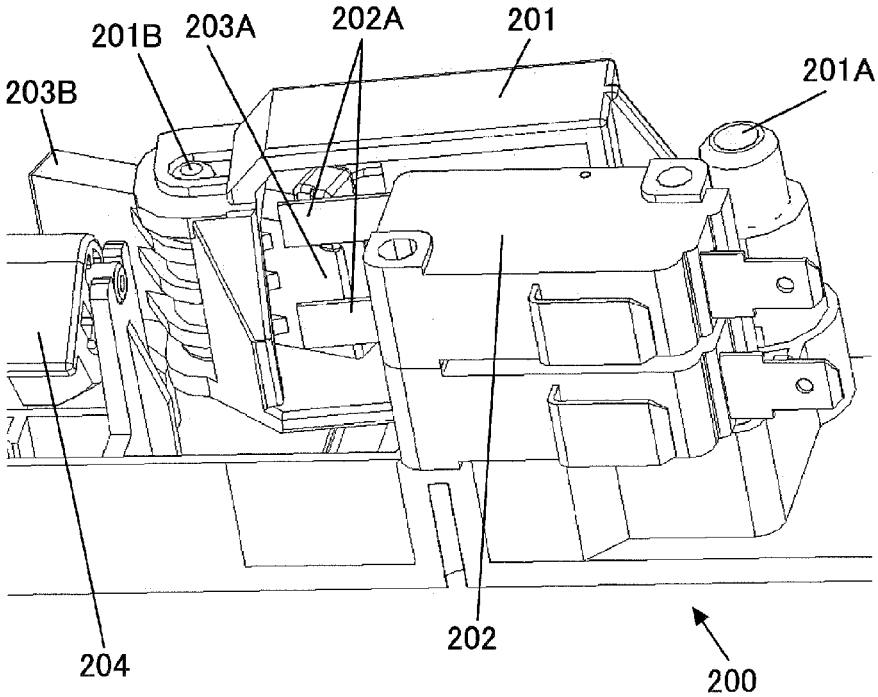

FIGS. 1A and 1B are perspective views of an interlock switch mechanism according to a first embodiment of the present invention.

As shown in FIGS. 1A and 1B, the interlock switch mechanism 200 contains a main body 200A, a first link rod 201, a switch 202, a second link rod 203, an action part 204, and a stroke extension mechanism 205. The first link rod 201 is disposed on the main body 200A, and may swing by centering on a supporting point 201A. A supporting shaft 201B is disposed at an end 201C of the first link rod 201. The second link rod 203 is supported by the supporting shaft 201B at the first link rod 201 so that two ends 203A and 203B of the second link rod 203 may swing by centering on the supporting shaft 201B.

Under an action of a first external force F1, the stroke extension mechanism 205 may cause the first link rod 201 to swing so as to let the end 203A of the second link rod 203 approach an actuator 202A of the switch 202. Under an action of a second external force F2, the action part 204 may make contact with the other end 203B of the second rod 203 so as to cause the end 203A swing to approach the actuator 202A of the switch 202.

It is preferred that the action part 204 be a rotation part like a cam that may rotate with respect to a rotation shaft, as shown in FIGS. 1A and 1B. However, it should be noted that the preset invention is not limited to this. In other words, it is possible to adopt a mechanism such as the stroke extension mechanism 205, a technical means such as disclosed in Japan Patent Application No. 2009-37997, or any other proper conventional technical approach.

The interlock switch mechanism 200 further contains plural reset units. When the first or second external force F1 or F2 is cancelled, the plural reset units may cause the switch 202 to be turned off immediately. It is preferred that the plural reset units be elastic bodies such as coil springs disposed at the supporting point 201A, the supporting shaft 201B, and the rotation shaft of the action part 204. However, it should be noted that the present invention is not limited to this. In other words, it is possible to adopt a technical means such as disclosed in Japan Patent Application No. 2009-37997 or any other proper conventional technical approach.

As shown in FIGS. 1A and 1B, in this embodiment, the supporting point 201A of the first link rod 201 is disposed at its end. However, it should be noted that the first link rod 201 may adopt a technical means such as disclosed in Japan Patent Application No. 2009-37997 or any other proper conventional technical approach.

Figure 2:
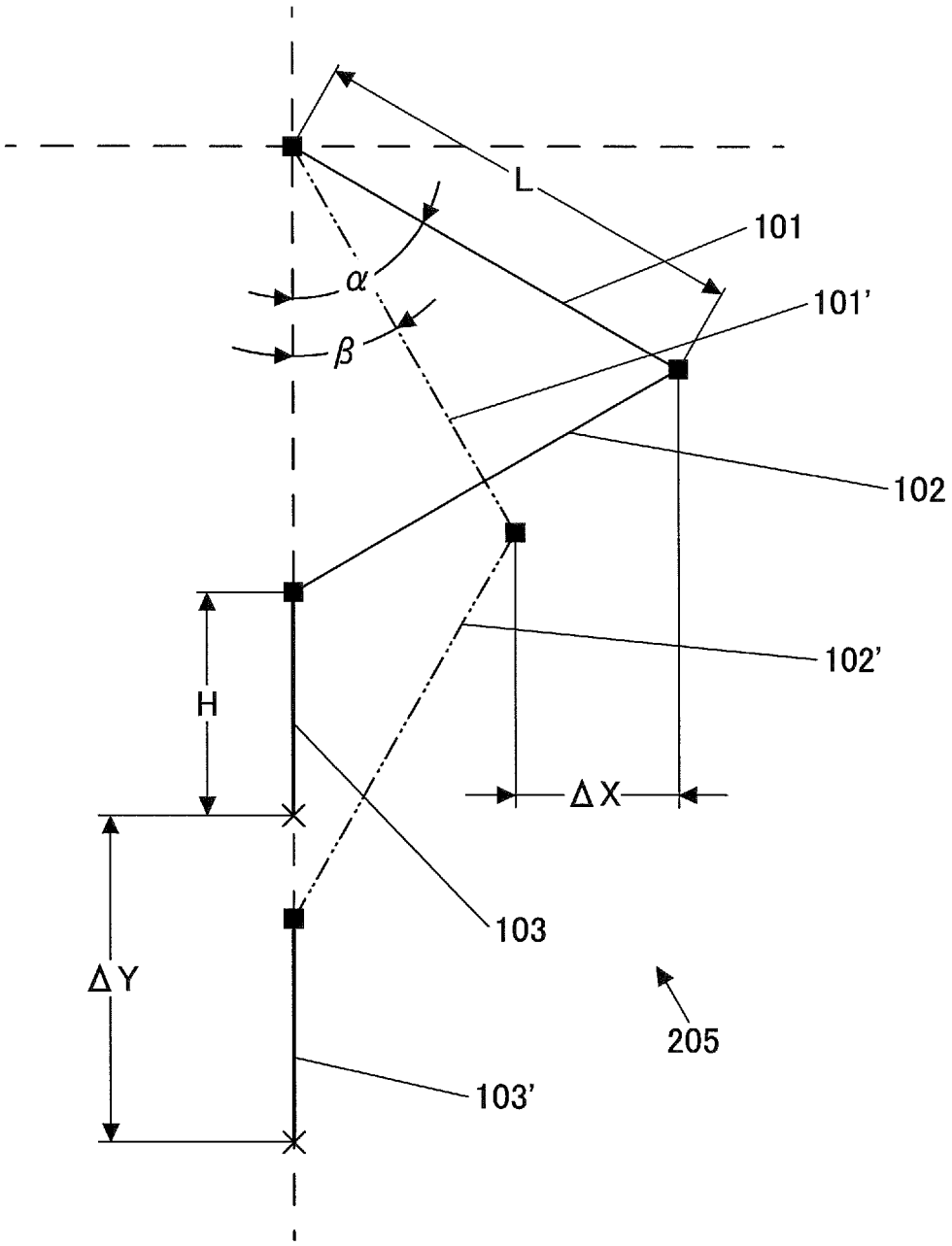
FIG. 2 illustrates how a stroke extension mechanism works in the interlock switch mechanism according to the first embodiment of the present invention.

FIG. 2 illustrates how the stroke extension mechanism 205 works in the interlock switch mechanism 200 according to the first embodiment of the present invention.

A first stroke ΔX of the stroke extension mechanism 205 generated by the first external force F1 is converted into a second stroke ΔY normal to the first stroke ΔX by the stroke extension mechanism 205, and the second stroke ΔY is greater than the first stroke ΔX.

Figure 3:
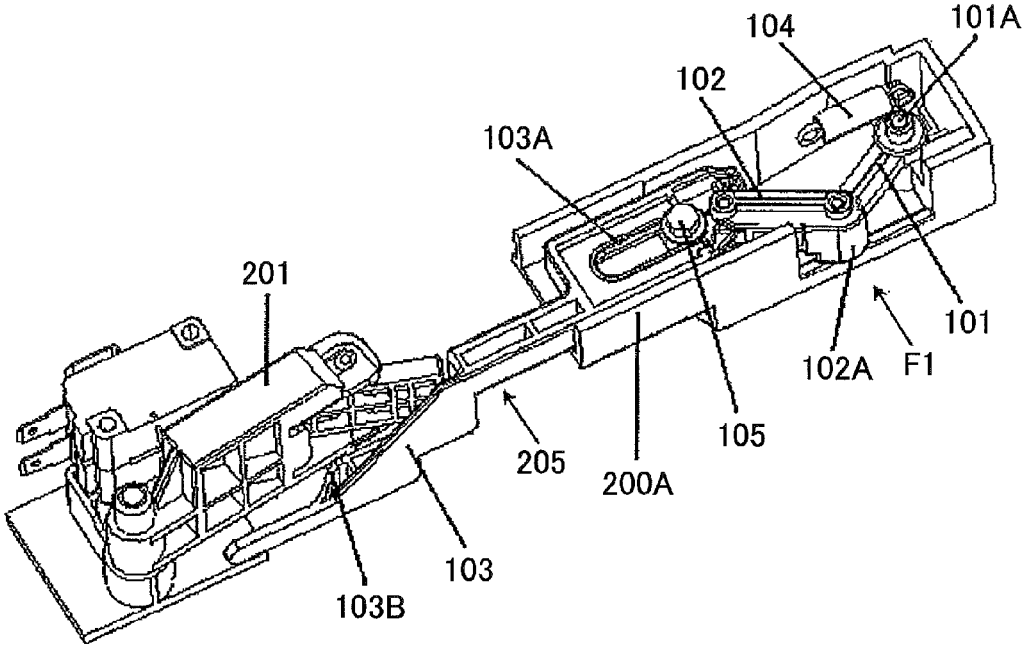
FIG. 3 illustrates a structure of the stroke extension mechanism utilized in the interlock switch mechanism according to the first embodiment of the present invention.

FIG. 3 illustrates a structure of the stroke extension mechanism 205 utilized in the interlock switch mechanism 200 according to the first embodiment of the present invention.

The stroke extension mechanism 205 includes a third link rod 101, a fourth link rod 102, and a fifth link rod 103. An end of the third link rod 101 is rotatably supported by a rotation shaft 101A. An end of the fourth link rod 102 is rotatably connected to another end of the third link rod 101. The first external force F1 pushes the connection 102A of the third and fourth link rods 101 and 102 so that the connection 102A may move a distance of the first stroke ΔX along the direction of the first external force F1. The fifth link rod 103 may move a distance of the second stroke ΔY. An end of the fifth link rod 103 is rotatably connected to another end of the fourth link rod 102. Another end of the fifth link rod 103 drives the first link rod 201.

Two guide units are disposed on the fifth link rod 103 and the main body 200A, respectively, and are cooperative. That is, the two guide units may keep the fifth link rod 103 to stay on the main body 200A, and may cause the fifth link rod 103 to move along a straight line at the same time.

It is preferred that the guide units be a long and thin guide slot 103A and a screw nut 105. The guide slot 103A is disposed on the fifth link rod 103. The screw nut 105 is screwed into the main body 200A through the guide slot 103A so as to keep the fifth link rod 103 to stay on the main body 200A and to cause the fifth link rod 103 to be able to move along a straight line. By adopting these kinds of guide units, it is not only possible to ensure that the fifth link rod 103 may move along a straight line, but also possible to prevent the fifth link rod 103 from loosening when the fifth link rod 103 moves. Here it should be noted that the guide units may be designed as having any other conventional guide manner, for example, a guide manner using a guide member (e.g., a roller) and a guide rail.

Figure 4:
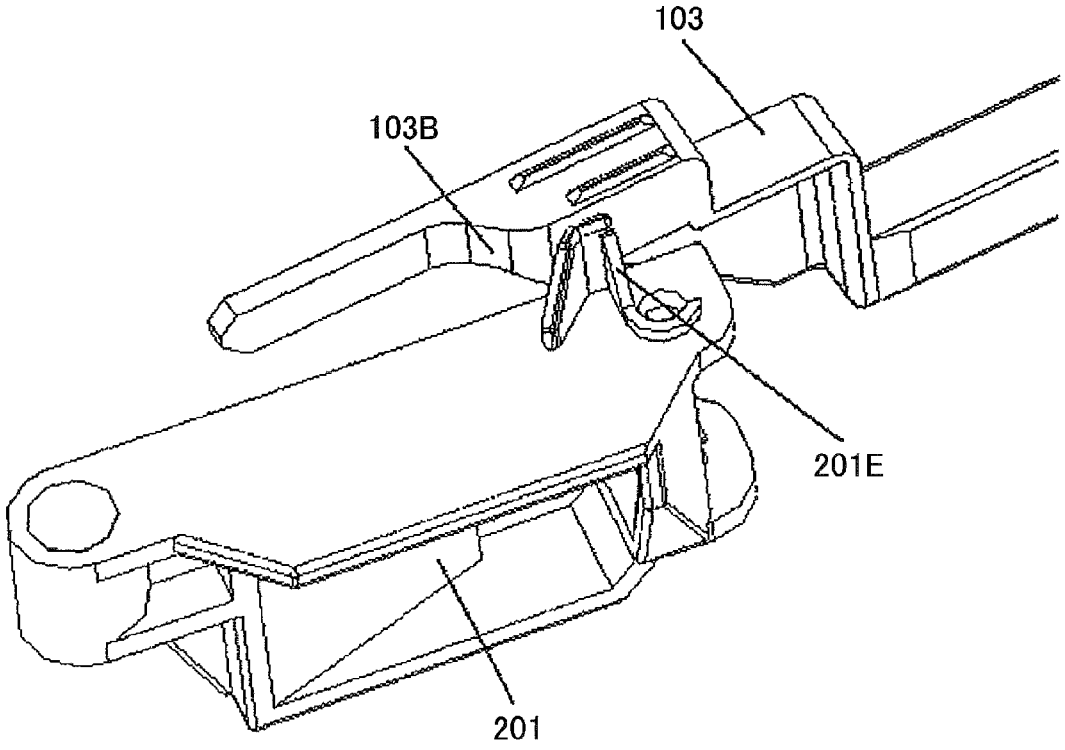
FIG. 4 is a locally enlarged view showing the contact of an end of a fifth link rod and a first link rod, as shown in FIG. 3.

FIG. 4 is a locally enlarged view showing the contact of the other end of the fifth link rod 103 and the first link rod 201, as shown in FIG. 3.

The other end of the fifth link rod 103 has a sloped side 103B. A contacting portion 201E is disposed on a side wall of the first link rod 201, and the contacting portion 201E may make contact with the sloped side 103B. When the fifth link rod 103 moves the second stroke ΔY, the contacting portion 201E of the first link rod 201 slides along the sloped side 103B so as to push the first link rod 201 to approach the switch 202.

When the first external force F1 is cancelled, under a reset action of the reset unit of the first link rod 201, the stroke extension mechanism 205 may reset with the reset action of the first link rod 201. It is also possible to dispose a reset unit on the stroke extension mechanism 205 itself. It is preferred that a spring 104 be disposed on the stroke extension mechanism 205 to serve as the reset unit. An end of the spring 104 is fixed firmly to the main body 200A, and another end of the spring 104 is connected to the end of the fifth link rod 103.

The spring 104 is employed for returning the stroke extension mechanism 205 to an initial state where the first external force F1 is not applied. The reset unit may also be a coil spring set on the rotation shaft 101A of the third link rod 101, or may adopt any other proper conventional technical means.

In what follows, the design theory of the stroke extension mechanism 205 is set forth concretely.

As shown in FIG. 2, ΔX refers to the first stroke, ΔY refers to the second stroke, and L refers to the length between the centers of the rotation shafts at the two ends of the third link rod 101. α refers to an angle between the third link rod 101 and the fifth link rod 103 when the first external force F1 is not applied. After the first external force F1 is applied, the third link rod 101, the fourth link rod 102, and the fifth link rod 103 move to positions shown by lines 101', 102', and 103' in FIG. 2, respectively, and the angle α is converted to β. The relationship of these parameters is as follows.

$$\Delta X/\Delta Y=(\sin\alpha-\sin\beta)L/2(\cos\beta-\cos\alpha)L=\tfrac{1}{2}*ctg[(\alpha+\beta)/2]$$

$(0°<\alpha<90°$ and $0°<\beta<90°)$

On the basis of the above equation, it is possible to obtain the following data table.

| | α (°) | X | Y | ΔX | ΔY |
|---|---|---|---|---|---|
| 1 | 80 | 0.31 | 7.12 | 0.39 | 3.49 |
| 2 | 75 | 0.7 | 10.61 | 0.54 | 3.41 |
| 3 | 70 | 1.24 | 14.02 | 0.68 | 3.31 |
| 4 | 65 | 1.92 | 17.33 | 0.83 | 3.17 |
| 5 | 60 | 2.75 | 20.5 | 0.96 | 3.02 |
| 6 | 55 | 3.71 | 23.5 | 1.09 | 2.83 |
| 7 | 50 | 4.8 | 26.4 | 1.2 | 2.64 |
| 8 | 45 | 6 | 29 | 1.32 | 2.42 |
| 9 | 40 | 7.32 | 31.4 | 1.42 | 2.18 |
| 10 | 35 | 8.74 | 33.6 | 1.51 | 1.92 |
| 11 | 30 | 10.3 | 35.5 | 1.59 | 1.65 |
| 12 | 25 | 11.84 | 37.16 | 1.65 | 1.37 |
| 13 | 20 | 13.49 | 38.53 | 1.7 | 1.07 |
| 14 | 15 | 15.19 | 39.6 | 1.75 | 0.78 |
| 15 | 10 | 16.94 | 40.38 | | |

It is understood according to the above data table that when the angle α is defined as greater than or equal to 30 degrees, the second stroke ΔY is greater than the first stroke ΔX. It is preferred that the angle α be defined as greater than or equal to 30 degrees and less than or equal to 80 degrees, i.e., $30°\leq\alpha\leq80°$.

In the interlock switch mechanism 200 according to the first embodiment of the present invention, when the second external force F2 is applied to the action part 204, the action part 204 makes contact with the second link rod 203 so as to cause the end 203A to swing to approach the actuator 202A of the switch 202. When the first external force F1 is applied to the stroke extension mechanism 205, the connection 102A of the third link rod 101 and the fourth link rod 102 is pushed so that the connection 102A may move a distance of the first stroke ΔX along the direction of the first external force F1. In a process where the connection 102A moves, the fourth link rod 102 pushes the fifth link rod 103 so as to cause the fifth link rod 103 to move a distance of the second stroke ΔY; in this way, the first link rod 201 is pushed, and then swings so that the end 203A of the second link rod 203 approaches the actuator 202A of the switch 202. As a result, under the combined action of the first external force F1 and the second external force F2, the actuator 202A of the switch 202 is triggered so that the switch 202 is turned on.

When the first external force F1 begins to be cancelled, the connection 102A of the third link rod 101 and the fourth link rod 102 may generate a relatively shorter reset displacement, whereas the fifth link rod 103 may generate a relatively longer reset displacement. This may ensure that the end 203A of the second link rod 203 may rapidly escape from the actuator 202A so as to cause the switch 202 to be turned off.

As a result, by utilizing the interlock switch mechanism 200 according to the first embodiment of the present invention, it is possible to effectively improve the switch control accuracy.

Moreover, by employing the guide units disposed on the interlock switch mechanism 200, it is possible to render the switch control process stable. Furthermore, by using the sloped side 103B disposed at the other end of the fifth link rod 103, it is possible to mitigate the changes of the first external force F1 so as to further improve the switch control accuracy.

In addition, in the interlock switch mechanism 200, the angle α between the third link rod 101 and the fifth link rod 103 is defined as greater than or equal to 30 degrees and less than or equal to degrees. This may effectively extend the first stroke ΔX so as to guarantee that the switch control accuracy may be effectively improved.

Figure 5:
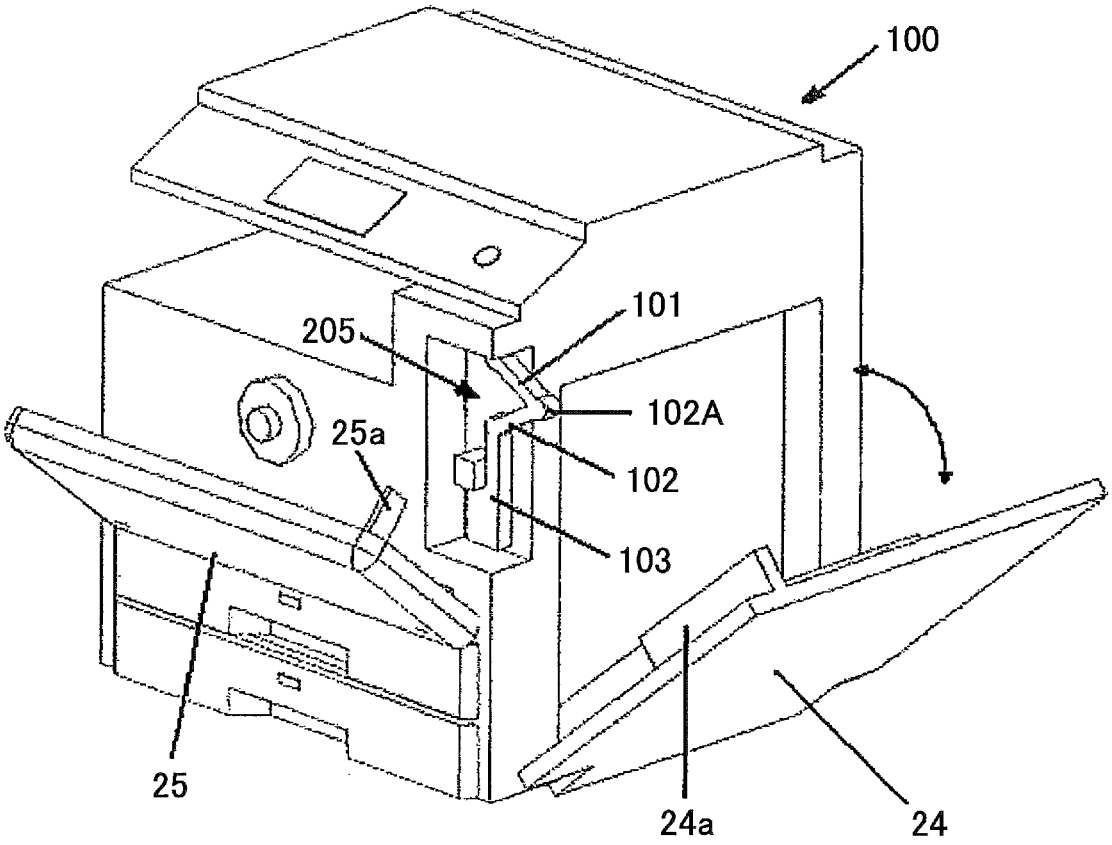
FIG. 5 illustrates an image formation device according to a second embodiment of the present invention, wherein, the image formation device utilizes the interlock switch mechanism according to the first embodiment of the present invention.

FIG. 5 illustrates an image formation device according to a second embodiment of the present invention. The image formation device utilizes the interlock switch mechanism according to the first embodiment of the present invention.

As shown in FIG. 5, the image formation device 100 contains a first door 24 and a second door 25. A first boss 24*a* is disposed on the inner surface of the first door 24, and a second boss 25*a* is disposed on the inner surface of the second door 25. When the first door 24 is closed, the first boss 24*a* applies a first external force F1 to the stroke extension mechanism 205. When the second door 25 is closed, the second boss 25*a* applies a second external force F2 to the action part 204.

Figure 6:
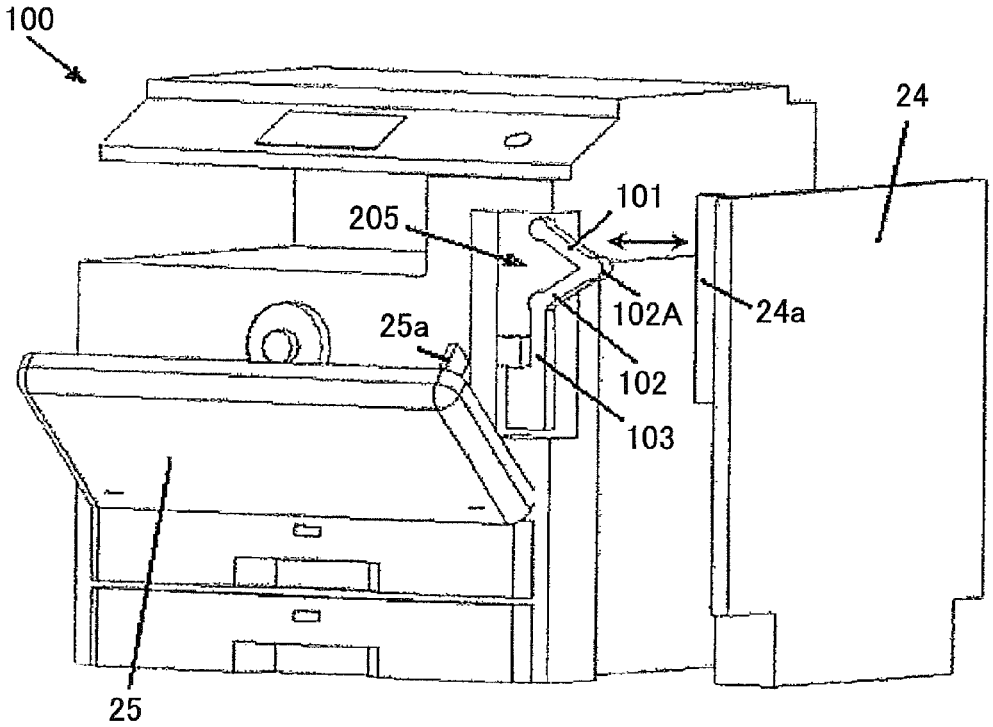
FIG. 6 illustrates a first modification of the image formation device according to the second embodiment of the present invention.

In particular, the first boss 24*a* faces the connection 102A of the third link rod 101 and the fourth link rod 102, and may apply the first external force F1 to the connection 102A. As shown in FIG. 6, regarding to a first door 24 which is closed in a rotational manner, it is preferred that the first boss 24*a* be disposed on the top end portion of the first door 24. When the first door 24 is closed, the moving distance of the top end portion thereof is maximum; as a result, it is possible to increase the first stroke ΔX. This may result in further increasing the second stroke ΔY.

FIG. 6 illustrates a first modification of the image formation device according to the second embodiment of the present invention.

In this modification, when the first door 24 is closed, it moves along a horizontal direction.

Figure 7:
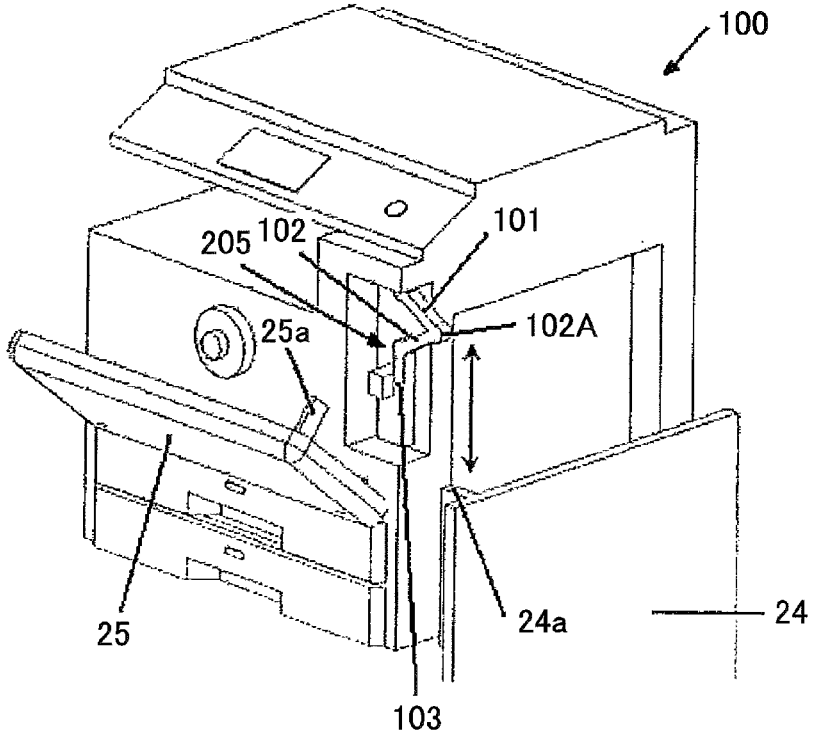
FIG. 7 illustrates a second modification of the image formation device according to the second embodiment of the present invention.
Figure 8:
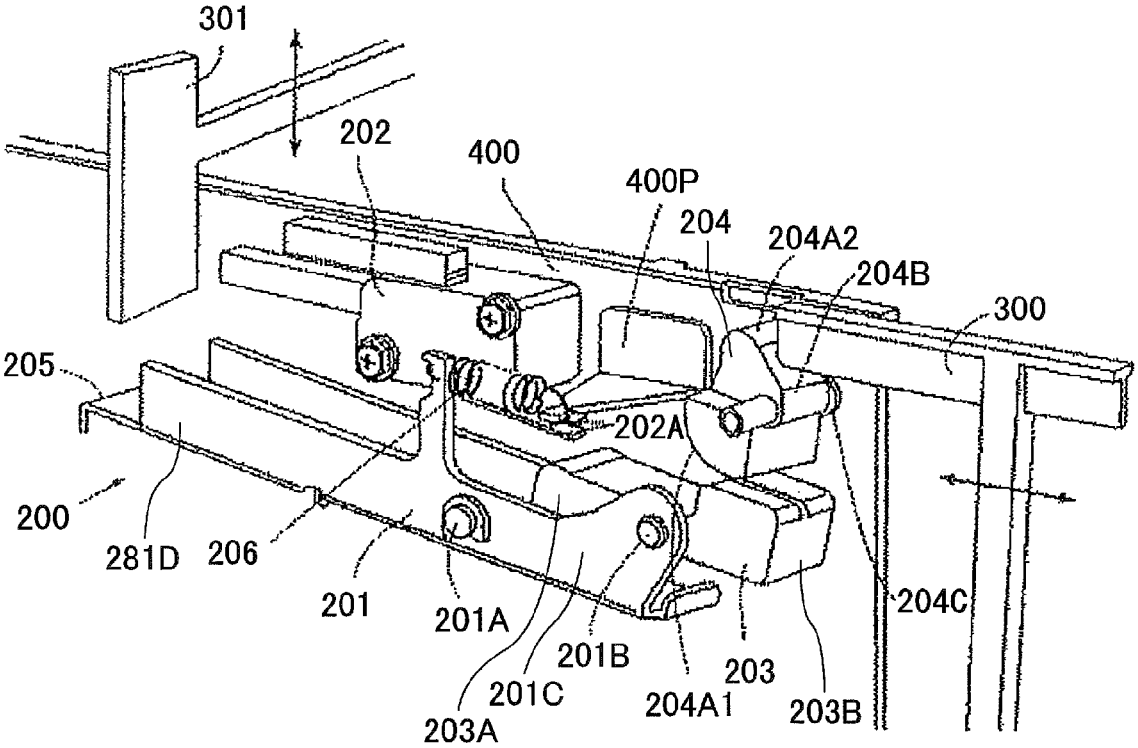
FIG. 8 illustrates a conventional interlock switch mechanism.
Figure 9:
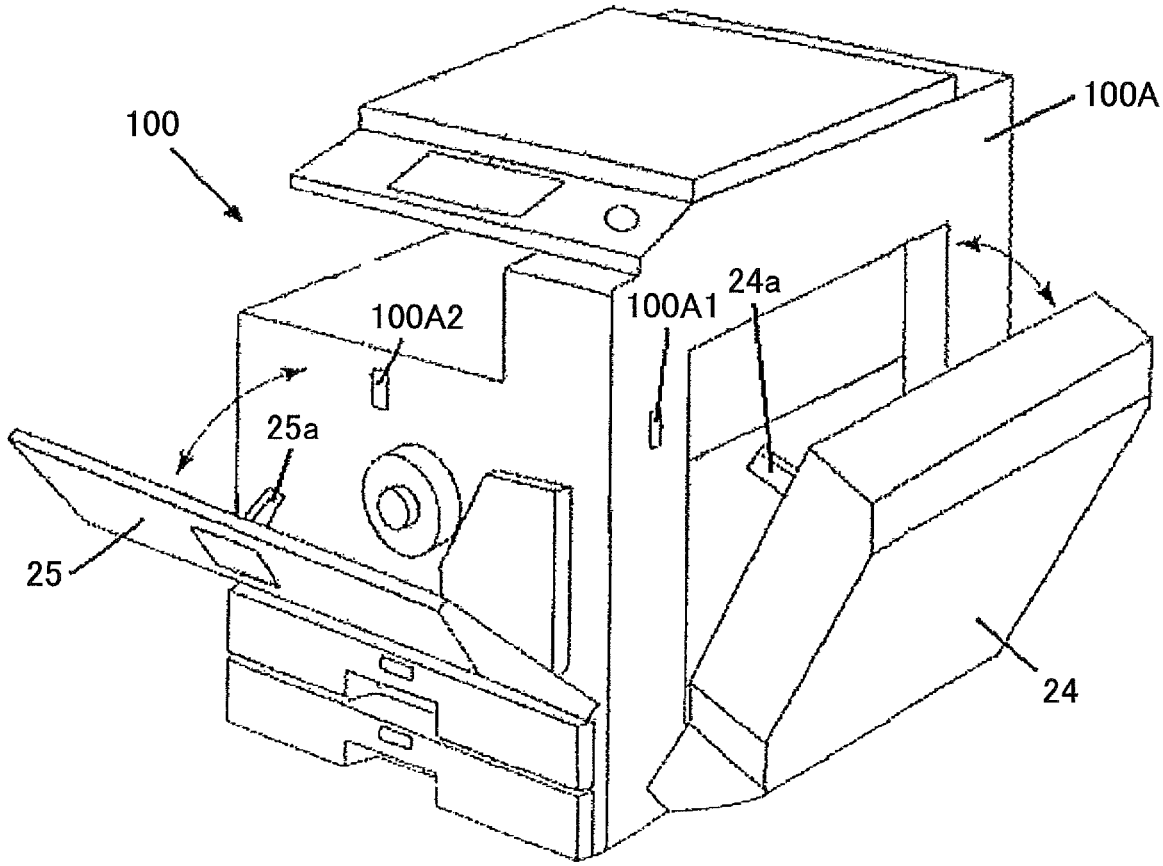
FIG. 9 illustrates a conventional image formation device.

FIG. 7 illustrates a second modification of the image formation device according to the second embodiment of the present invention.

In this modification, when the first door 24 is closed, it moves along a vertical direction.

Therefore, by installing the interlock switch mechanism 200 according to the first embodiment of the present invention in the above described image formation device, it is possible to accurately detect the openness of the door in the image formation device. Even when the door of the image formation device is opened a little, the interlock switch mechanism 200 may make a response at once so as to cause the switch 202 to be turned off.

While the interlock switch mechanism and the image formation device using the same are described with reference to the specific embodiments chosen for the purpose of illustration, it should be apparent that the present invention is not limited to these embodiments, but numerous modifications could be made thereto by those people skilled in the art without departing from the basic concept and technical scope of the present invention.

The present application is based on Chinese Priority Patent Application No. 201210043430.2 filed on Feb. 24, 2012, the entire contents of which are hereby incorporated by reference.

What is claimed is:

1. An interlock switch mechanism comprising:

a main body;

a first link rod, which is disposed on the main body, configured to swing by centering on a supporting point, wherein, a supporting shaft is disposed at an end of the first link rod;

a second link rod which is supported by the supporting shaft at the first link rod, wherein, first and second ends of the second link rod are configured to swing by centering on the supporting shaft;

an action part which, under an action of a second external force, is configured to make contact with the first end of the second link rod so as to cause the second end of the second link rod to swing toward an actuator of a switch; and a stroke extension mechanism which, under an action of a first external force, is configured to cause the first link rod to swing so as to cause the second end of the second link rod to swing toward the actuator of the switch, wherein, a first stroke of the stroke extension mechanism generated by the first external force is converted to a second stroke normal to the first stroke by the stroke extension mechanism, and the second stroke is greater than the first stroke, and the stroke extension mechanism includes:

a third link rod whose first end is rotatably supported by a rotation shaft;

a fourth link rod whose first end is rotatably connected to a second end of the third link rod, wherein, the first external force pushes a connection of the third link rod and the fourth link rod so as to cause the connection to be able to move the first stroke along a direction of the first external force; and a fifth link rod which may move the second stroke, wherein, a second end of the fourth link rod is rotatable connected to a first end of the fifth link rod, and a second end of the fifth link rod drives the first link rod.

2. The interlock switch mechanism according to claim 1, wherein:

guide units are disposed on the fifth link rod and the main body, respectively, and are able to be cooperative.

3. The interlock switch mechanism according to claim 2, wherein:

the guide units include a guide slot and a screw nut.

4. The interlock switch mechanism according to claim 1, wherein:

the second end of the fifth link rod has a sloped side.

5. The interlock switch mechanism according to claim 1, wherein:

the stroke extension mechanism has a reset unit.

6. The interlock switch mechanism according to claim 1, wherein:

an angle between the third link rod and the fifth link rod is greater than or equal to 30 degrees and less than or equal to 80 degrees.

7. An image formation device comprising:

the interlock switch mechanism according to claim 1.

8. The image formation device according to claim 7, further comprising:

a first door;

a first boss disposed on an inner surface of the first door;

a second door; and a second boss disposed on an inner surface of the second door.

9. The image formation device according to claim 8, wherein:

the first boss is disposed on a top end portion of the first door.

* * * * *